US008951954B2

(12) United States Patent
Kron et al.

(10) Patent No.: US 8,951,954 B2
(45) Date of Patent: Feb. 10, 2015

(54) LOW VOLATILE ORGANIC COMPOUNDS CLEANER COMPOSITION

(75) Inventors: Ryan E. Kron, Racine, WI (US); Lance D. Brown, Racine, WI (US)

(73) Assignee: Diversey, Inc., Racine, WI (US)

( * ) Notice: Subject to any disclaimer, the term of this patent is extended or adjusted under 35 U.S.C. 154(b) by 325 days.

(21) Appl. No.: 12/867,220

(22) PCT Filed: Feb. 18, 2009

(86) PCT No.: PCT/US2009/034372

§ 371 (c)(1),
(2), (4) Date: Aug. 11, 2010

(87) PCT Pub. No.: WO2009/105453

PCT Pub. Date: Aug. 27, 2009

(65) Prior Publication Data

US 2010/0311631 A1 Dec. 9, 2010

Related U.S. Application Data

(60) Provisional application No. 61/066,448, filed on Feb. 20, 2008.

(51) Int. Cl.

| | |
|---|---|
| ***C11D 3/60*** | (2006.01) |
| ***C11D 3/43*** | (2006.01) |
| ***C11D 1/00*** | (2006.01) |
| ***C11D 3/20*** | (2006.01) |
| ***C11D 3/30*** | (2006.01) |

(52) U.S. Cl.

CPC ..... *C11D 1/004* (2013.01); *C11D 3/2034* (2013.01); *C11D 3/2068* (2013.01); *C11D 3/30* (2013.01)

USPC ..... 510/214

(58) Field of Classification Search

USPC ..... 510/214

See application file for complete search history.

(56) References Cited

U.S. PATENT DOCUMENTS

| | | | | |
|---|---|---|---|---|
| 3,332,880 | A | 7/1967 | Kessler et al. | |
| 3,717,630 | A | 2/1973 | Booth | |
| 4,111,855 | A | 9/1978 | Barrat et al. | |
| 4,284,435 | A | 8/1981 | Fox | |
| 4,376,175 | A * | 3/1983 | Posten | 523/501 |
| 4,865,773 | A | 9/1989 | Kim et al. | |
| 5,156,675 | A * | 10/1992 | Breton et al. | 106/31.43 |
| 5,536,450 | A | 7/1996 | Masters et al. | |
| 6,060,439 | A * | 5/2000 | Doyel et al. | 510/164 |
| 6,774,099 | B1 * | 8/2004 | Scheibel et al. | 510/357 |
| 6,953,299 | B2 * | 10/2005 | Wang et al. | 401/279 |
| 7,022,801 | B2 * | 4/2006 | Medsker | 528/27 |
| 7,071,153 | B2 * | 7/2006 | Lewis et al. | 510/240 |
| 2002/0004469 | A1 * | 1/2002 | Faber | 510/180 |
| 2002/0137658 | A1 * | 9/2002 | Faber | 510/470 |
| 2002/0155969 | A1 * | 10/2002 | Rees et al. | 510/384 |
| 2003/0027010 | A1 | 2/2003 | Olson et al. | |
| 2003/0119710 | A1 * | 6/2003 | Dicke et al. | 510/470 |
| 2005/0032659 | A1 | 2/2005 | Shirota | |
| 2005/0245424 | A1 * | 11/2005 | Patel et al. | 510/439 |
| 2006/0223732 | A1 | 10/2006 | Hori et al. | |
| 2007/0087952 | A1 | 4/2007 | Hei et al. | |
| 2007/0191252 | A1 * | 8/2007 | Kilkenny et al. | 510/424 |
| 2007/0191253 | A1 * | 8/2007 | Kilkenny et al. | 510/424 |
| 2008/0128003 | A1 * | 6/2008 | Ochomogo et al. | 134/34 |
| 2008/0293613 | A1 * | 11/2008 | Johnson et al. | 510/438 |
| 2009/0148342 | A1 * | 6/2009 | Bromberg et al. | 422/37 |

FOREIGN PATENT DOCUMENTS

| | | |
|---|---|---|
| JP | 07-179892 | 7/1995 |
| JP | 2005-002173 | 1/2005 |
| WO | 89/12673 | 12/1989 |
| WO | 97/32937 | 9/1997 |
| WO | 2010-073067 | 7/2010 |

OTHER PUBLICATIONS

The International Search Report from WO 2009/105453 (PCT/US2009/034372) prepared by the Korean Intellectual Property Office.

"Surface Active Agents and Detergents", vol. II by Schwartz, Perry and Berch, Interscience Publishers Inc., 1958.

Curren et al., The Background Review Document of an In Vitro Approach for EPA Toxicity Labeling of Antimicrobial Cleaning Products, Jul. 2008.

Gautheron, P., et al. "Bovine Corneal Opacity and Permeability Test: An In-Vitro Assay of Ocular Irritancy" Fundamental and Applied Toxicology, 1992, 18, 442-449.

Guidelines for Testing of Chemicals. Ready Biodegradability, Test Guideline 301. Organization for Economic Cooperative and Development. Paris, France 1992.

PCT/US2009/034372 Written Opinion dated Aug. 10, 2009 (5 pages).

PCT/US2011/037333 International Search Report and Written Opinion dated Jan. 13, 2012 (12 pages).

PCT/US2011/063683 International Search Report and Written Opinion dated Jul. 30, 2012 (8 pages).

European Patent Office Search Report for Application No. 09712066.1 dated Sep. 4, 2012 (6 pages).

* cited by examiner

*Primary Examiner* — Mark Eashoo

*Assistant Examiner* — M. Reza Asdjodi

(74) *Attorney, Agent, or Firm* — Michael Best & Friedrich LLP

(57) ABSTRACT

Disclosed herein are low volatile organic compound cleaner compositions which include a diethylene glycol monoalkyl ether, benzyl alcohol, and a fluorosurfactant. Also disclosed are low volatile organic compound cleaner compositions which include a diethylene glycol monoalkyl ether, benzyl alcohol, and an ethanolamine. Methods of using the compositions are also provided.

21 Claims, 8 Drawing Sheets

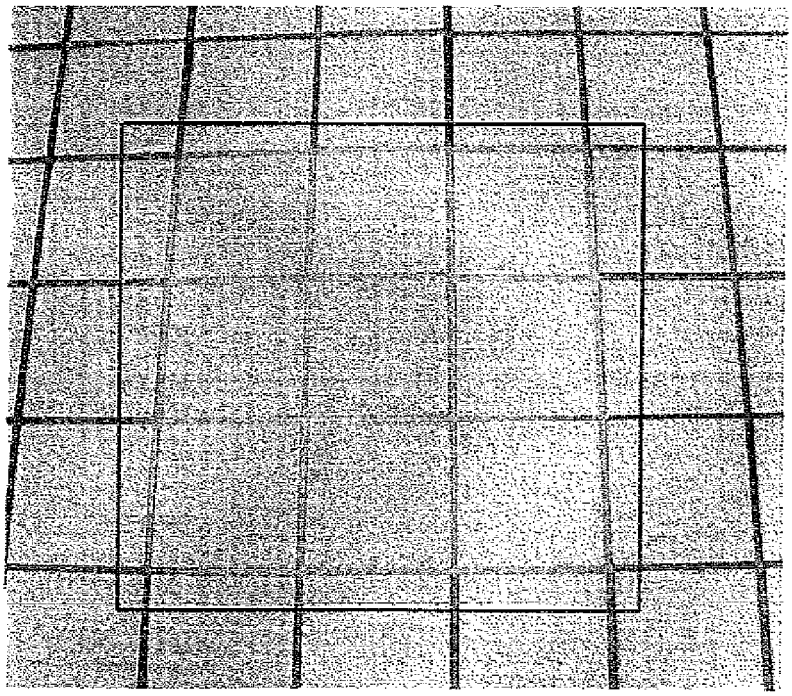
Figure 1. Tiles cleaned with 100 mls of Akzo PGA solution, neat.
10 minute dwell time and 3 scrubbings. Approximately 50% soil removal.
Average estimate of two separate trials.

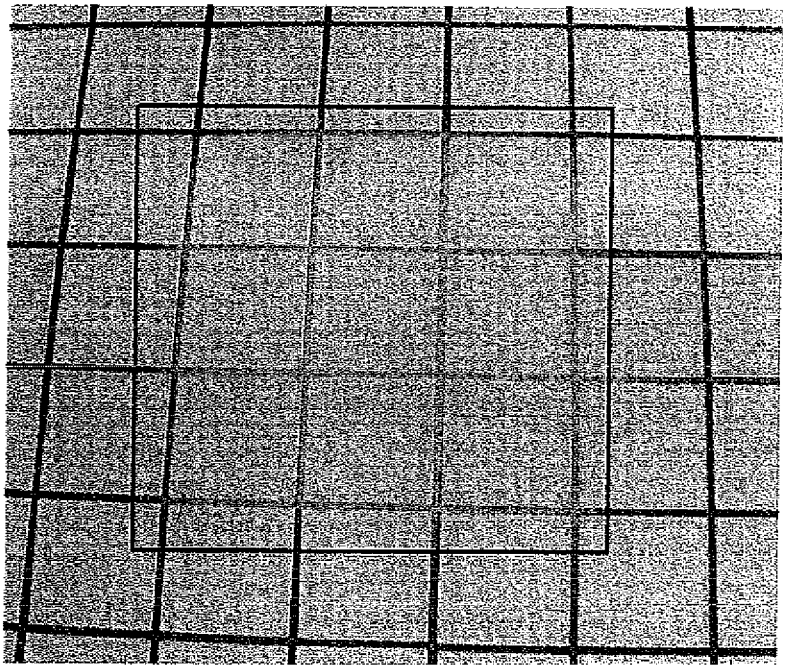
Figure 2. Tiles cleaned with 100 mils of JWP Pro-Strip solution, neat. 10 minute dwell time and 3 scrubbings. Approximately 80% soil removal.

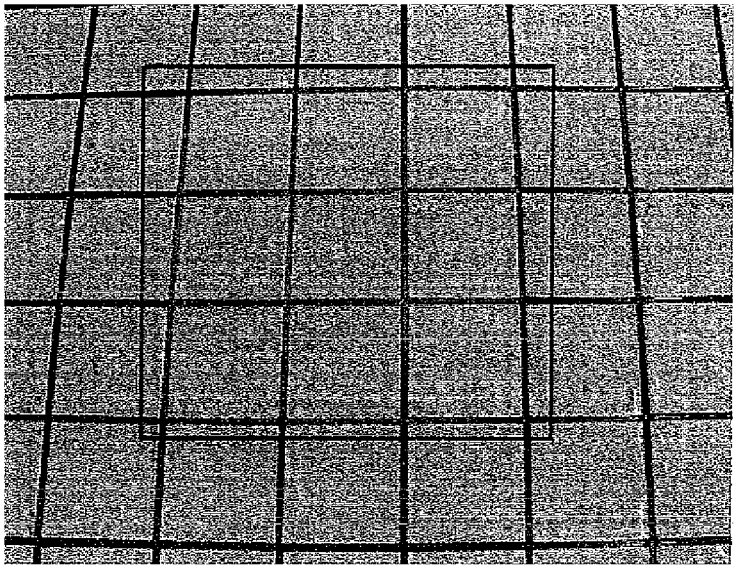
Figure 3. Tiles cleaned with 100 mils of a prototype acid based solvent cleaner, neat. 10 minute dwell time and 3 scrubbings. Approximately 30% soil removal.

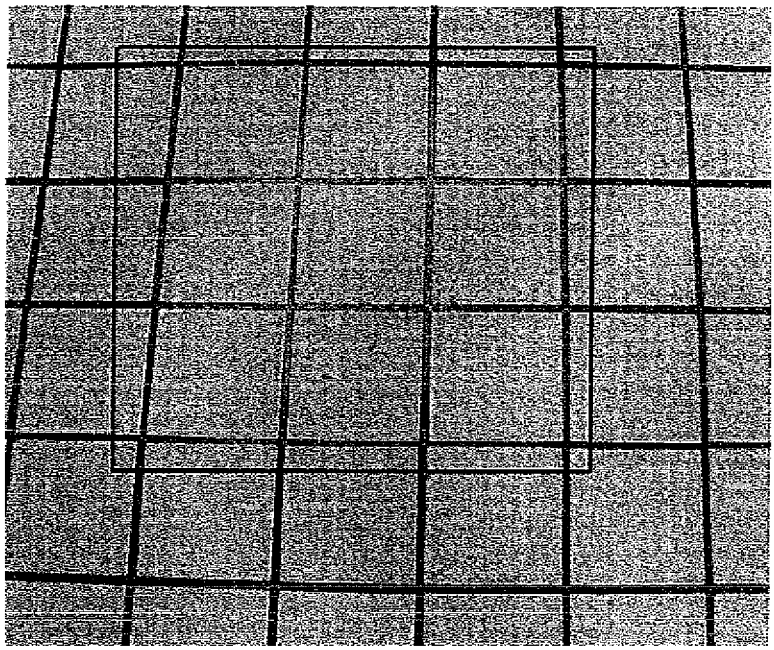
Figure 4. Tiles cleaned with 100 mils of EMA Oxivir, neat. EMA Oxivir contains 4% solvent, 4.2% phosphonic acid, 2% phos acid, and 6.9% hydrogen peroxide. 10 minute dwell time and 3 scrubbings. Approximately 35% soil removal.

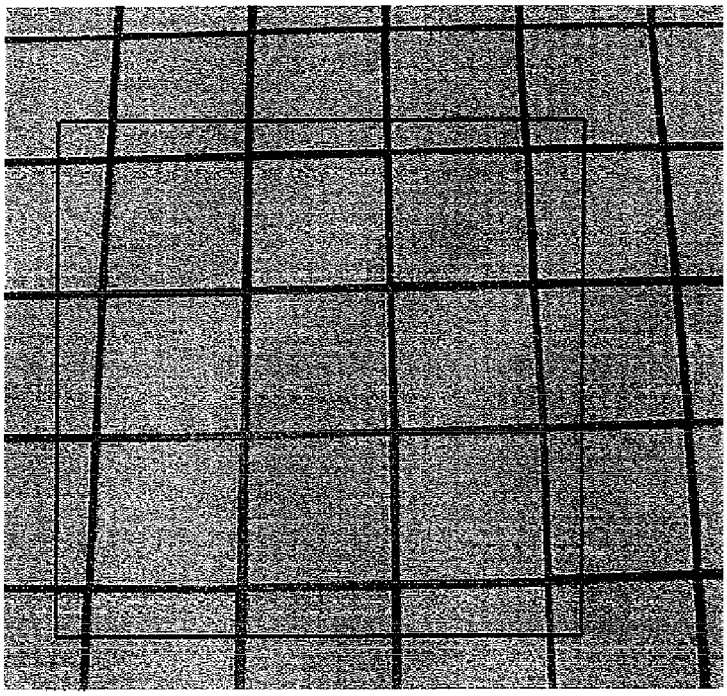
Figure 5. Tiles cleaned with 100 mils of JWP Alpha HP, neat. Alpha HP contains 8% solvent, 2% phos acid, and 4.25% hydrogen peroxide. 10 minute dwell time and 3 scrubbings. Approximately 20% soil removal.

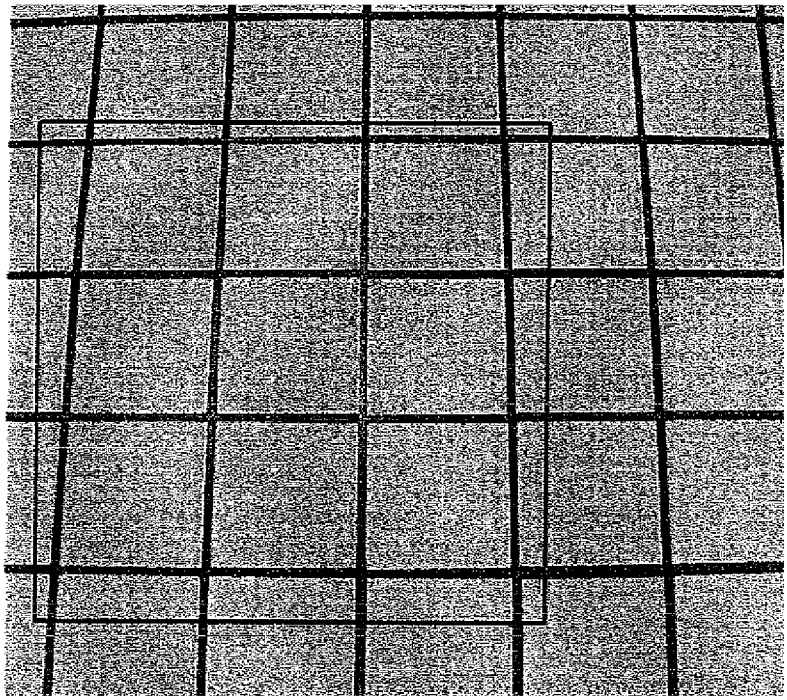
Figure 6. Tiles cleaned with 100 mils of 1500 ppm PAA. 10 minute dwell time and 3 scrubbings. Approximately 10% soil removal.

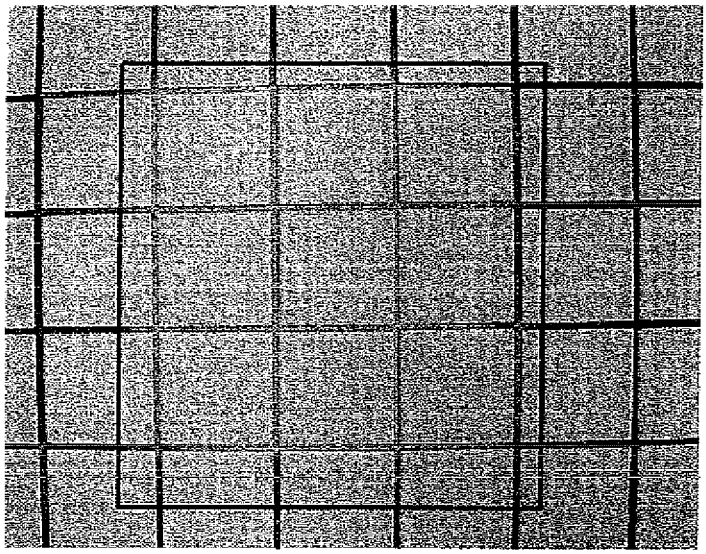
Figure 7. Tiles cleaned with 100 mls of prototype low VOC floor cleaner. 10 minute dwell time and 3 scrubbings. Approximately 85-90% soil removal.

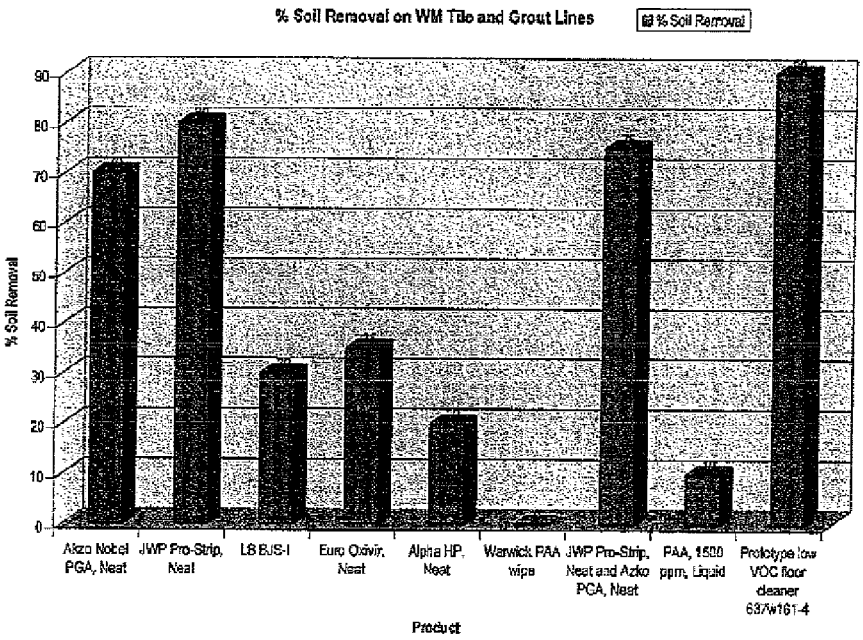
Figure 8. Summary of % soil removal of various cleaning products on Walmart restroom tile and grout. Testing performed on Thursday, August 10, 2006 in Racine Walmart.

LOW VOLATILE ORGANIC COMPOUNDS CLEANER COMPOSITION

BACKGROUND

Although a wide variety of cleaning compositions are known in the art, few of these are effective at cleaning porous surfaces, such as concrete, tile, stone, ceramic and grout. These porous materials are prone to trapping soils, making soil removal especially difficult.

In addition, many of the known cleaner compositions have relatively high levels of volatile organic compounds (VOC). These cleaners may not be acceptable for use in an enclosed environment, such as a restroom, and some may not be safe for routine or household use.

SUMMARY OF THE INVENTION

In one aspect, a cleaner composition is provided that includes a diethylene glycol monoalkyl ether, benzyl alcohol, and a fluorosurfactant. The cleaner composition includes at least about 12% by weight diethylene glycol monoalkyl ether. In another aspect, the cleaner composition has a surface tension of about 30 dynes or less.

In yet another aspect, a cleaner composition is provided that includes diethylene glycol monoalkyl ether, benzyl alcohol, and an ethanolamine. The pH of the composition is about 10.0 or higher and the cleaner composition includes at least about 12% by weight diethylene glycol monoalkyl ether.

In a further aspect, methods of cleaning a hard porous surface are provided. The cleaner compositions are first applied to the surface. Then, the cleaner composition on the surface is agitated to loosen the soil. Finally, the cleaner composition and loosened soil is removed from the surface.

BRIEF DESCRIPTION OF THE DRAWINGS

FIG. 1 is a photograph of tiles cleaned with Akzo Nobel's perglutaric acid mold and mildew remover.

FIG. 2 is a photograph of tiles cleaned with JWP Pro-Strip floor stripper.

FIG. 3 is a photograph of tiles cleaned with a prototype acid-solvent floor stripper.

FIG. 4 is a photograph of tiles cleaned with EMA Oxivir formulation cleaner.

FIG. 5 is a photograph of tiles cleaned with JWP Alpha HP formulation cleaner.

FIG. 6 is a photograph of tiles cleaned with Vigor Ox peracetic acid solution at 1500 ppm.

FIG. 7 is a photograph of tiles cleaned with the low VOC floor cleaner of Example 1.

FIG. 8 is a graph showing the percentage of soil removed from the tile and grout lines by the indicated cleaning products.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION OF THE INVENTION

Cleaning compositions with low VOC are provided herein. Suitably the cleaning compositions have 5% or less total VOCs. The prototype cleaner composition used in the Examples has 4.35% total VOCs. The low VOC cleaner compositions are acceptable for use in enclosed spaces. The California Air Resource Board (CARB) sets a limit of 5% total VOCs for this class of indoor cleaning products. In addition, the low VOC cleaner compositions described herein are more effective cleaners as shown in the Examples. Not to be limited to any theory, but one explanation for the superior cleaning results is that the low VOC cleaners allow the solvent to contact and lift the soil for an extended period of time due to the low level of evaporation. The cleaning compositions are useful for many cleaning purposes, but are suitably used to clean porous surfaces including, but not limited to, stone, concrete, tile, ceramic, masonry and grout. The cleaning compositions have an alkaline pH. Therefore, the cleaning compositions are useful on any surface that is not affected by treatment with alkali solutions.

In one aspect, a cleaner composition is provided that includes diethylene glycol monoalkyl ether, benzyl alcohol, and a fluorosurfactant. The cleaner composition includes at least about 12% by weight of the diethylene glycol monoalkyl ether. Suitably, the cleaner composition includes at least about 15% by weight diethylene glycol monoalkyl ether, more suitably it includes at least about 17% or 20% by weight diethylene glycol monoalkyl ether. Suitably, the cleaner composition includes less than about 55% by weight diethylene glycol monoalkyl ether, more suitably it includes less than about 50%, 45%, 40% or 35% by weight diethylene glycol monoalkyl ether. Unexpectedly, diethylene glycol monoalkyl ethers were shown to function significantly better and provided superior cleaning of grout lines than comparative cleaners containing ethylene glycol monoalkyl ether. As demonstrated in Example 2, the prototype cleaner of Example 1 performed significantly better than ethylene glycol monoalkyl ether cleaners such as Pro-Strip. Additionally, diethylene glycol monoalkyl ethers generally have lower volatility than ethylene glycol monoalkyl ethers.

Diethylene glycol monoalkyl ethers include, but are not limited to diethylene glycol monomethyl ether, diethylene glycol monoethyl ether, diethylene glycol monobutyl ether and diethylene glycol monopropyl ether. In the formulation of Example 1, diethylene glycol monoethyl ether and diethylene glycol monobutyl ether were used in combination.

The formulation in Example 1 below includes 14% by weight diethylene glycol monobutyl ether and 10% by weight diethylene glycol monoethyl ether. The cleaner composition may include from about 5% by weight to about 30% by weight diethylene glycol monobutyl ether. Suitably, the cleaner composition may include at least about 5% by weight diethylene glycol monobutyl ether, more suitably the composition includes at least about 7%, 10%, 12%, or 15% by weight diethylene glycol monobutyl ether. The composition may contain less than about 30% by weight diethylene glycol monobutyl ether, or suitably less than about 27%, 25%, 22%, 20%, 17% or 15% by weight diethylene glycol monobutyl ether. The cleaner composition may include from about 5% by weight to about 25% by weight diethylene glycol monoethyl ether. Suitably, the cleaner composition may include at least about 5% by weight diethylene glycol monoethyl ether, more suitably the composition includes at least about 7%, 10%, or 12%, by weight diethylene glycol monoethyl ether.

The composition may contain less than about 25% by weight diethylene glycol monoethyl ether, or suitably less than about 22%, 20%, 17%, 15%, 12% or 10% by weight diethylene glycol monoethyl ether.

Suitably, the diethylene glycol monobutyl ether and the diethylene glycol monoethyl ether are present in a weight ratio of from about 4:1 to about 1:2. More suitably, the cleaning composition contains at least as much diethylene glycol monobutyl ether as diethylene glycol monoethyl ether, i.e., the weight ratio of diethylene glycol monobutyl ether to diethylene glycol monoethyl ether is greater than or equal to a 1:1 ratio. The weight ratio of diethylene glycol monobutyl ether to diethylene glycol monoethyl ether is suitably from about 3:1 to 1:1, more suitably 3:1 to 2:1. In the Examples, a weight ratio of 2.8:1 was used.

The cleaning compositions also include benzyl alcohol. The formulation in Example 1 contains 5% by weight benzyl alcohol. Suitably, the cleaner composition contains at least about 1% by weight benzyl alcohol, more suitably the cleaner composition contains at least about 2%, 4%, 5%, or 7% by weight benzyl alcohol. Suitably the cleaner composition contains less than about 12% by weight benzyl alcohol, more suitably less than about 10%, 8%, or 6% by weight benzyl alcohol. In the Examples, benzyl alcohol is present in the cleaning compositions in a weight ratio of 1:2 with diethylene glycol monoethyl ether and a 1:2.8 weight ratio with diethylene glycol monobutyl ether. Suitably the diethylene glycol monoalkyl ether and the benzyl alcohol are present in a weight ratio of from about 10:1 to about 2:1, more suitably from about 8:1 to about 3:1, more suitably from about 6:1 to 4:1. Suitably, the weight ratio of diethylene glycol monoethyl ether to benzyl alcohol is from about 4:1 to about 1:1, more suitably from about 3:1 to about 2:1. Suitably, the weight ratio of diethylene glycol monobutyl ether to benzyl alcohol is from about 5:1 to about 1:1, more suitably from about 4:1 to about 2:1, more suitably from about 3:1 to about 2.5:1.

The cleaning compositions may also include a fluorosurfactant. Fluorosurfactants are well known to those of skill in the art and represent a class of surfactants with very good wetting ability. Suitable fluorosurfactants are available from DuPont deNemours & Co. and 3M, among other suppliers. Suitably, the fluorosurfactant is a non-ionic fluorosurfactant, such as Zonyl® FSO fluorosurfactant (DuPont), which was used in the compositions in the Examples. Other suitable fluorosurfactants include, but are not limited to, Zonyl® FSO-100, Zonyl® 9361, Zonyl® FS-300, Zonyl® FSH, Zonyl® FSN, and Zonyl® FSN-100 (all of which are available from Dupont). Similar fluorosurfactants are available from other suppliers such as 3M, Mason Chemical Co. and others.

The cleaning compositions may include from about 20 ppm to about 2500 ppm of a fluorosurfactant. In the Examples, the compositions contained 250 ppm of Zonyl® FSO fluorosurfactant obtained from DuPont. As one of skill in the art will appreciate the amount of fluorosurfactant included in the composition will depend on the fluorosurfactant chosen. Suitably, the composition includes at least about 20 ppm fluorosurfactant, suitably at least about 50 ppm, 100 ppm, 150 ppm, 200 ppm or 250 ppm. Suitably, the composition includes less than about 2500 ppm, more suitably less than about 2000 ppm, 1500 ppm, 1000 ppm, 500 ppm, or 300 ppm of a fluorosurfactant. The compositions may include from about 0.01% by weight to about 1% by weight fluorosurfactant. Suitably the compositions include at least about 0.01% by weight fluorosurfactant, more suitably at least about 0.05% by weight, 0.07% by weight or 0.1% by weight fluorosurfactant. Suitably the compositions include less than about 1% by weight fluorosurfactant, more suitably less than about 0.5%, 0.4% or 0.2% by weight fluorosurfactant. The compositions in the Examples include about 0.1% by weight fluorosurfactant.

In another aspect, the cleaner composition has a surface tension of about 33 dynes/cm or less. The inclusion of the fluorosurfactant is believed to provide a suitably low surface tension. Low surface tension is believed to allow penetration of the cleaner composition into porous materials and result in more thorough cleaning. Suitably, the surface tension of the composition is less than about 30 dynes/cm. More suitably the surface tension of the composition is less than about 28 dynes/cm, 26 dynes/cm, 25 dynes/cm or 24 dynes/cm. Suitably, the surface tension is at least about 16 dynes/cm, more suitably the surface tension is more than about 18 dynes/cm or 20 dynes/cm. The composition of Example 1 had a surface tension of about 30 dynes/cm. A 1:2 dilution of the composition of Example 1 had a surface tension of 28 dynes/cm and a 1:4 dilution had a surface tension of 25 dynes/cm.

The cleaner compositions may also include an ethanolamine. The ethanolamine may be any ethanolamine known to those of skill in the art, but suitably is monoethanolamine, diethanolamine, or triethanolamine. In the examples, monoethanolamine was used at a concentration of 4% by weight. Those of skill in the art will appreciate that more or less ethanolamine could be used within the scope of the invention. Suitably, the composition includes at least about 0.5% by weight ethanolamine, more suitably at least about 1%, 2%, or 4% by weight ethanolamine is included. Suitably, the ethanolamine is less than about 10% by weight, more suitably less than about 8%, 6% or 5% by weight of the composition. Suitably the weight ratio of diethylene glycol monoalkyl ether to ethanolamine is from about 8:1 to about 2:1, suitably from about 6:1 to about 3:1. Suitably the weight ratio of ethanolamine to diethylene glycol monoethyl ether is from about 1:1 to about 1:4. More suitably the weight ratio of ethanolamine to diethylene glycol monoethyl ether is from about 1:2 to about 1:3. In the Examples, the composition has a weight ratio of ethanolamine to diethylene glycol monoethyl ether of 1:2.5. The weight ratio of ethanolamine to diethylene glycol monobutyl ether is suitably from about 1:2 to about 1:6. More suitably the weight ratio of ethanolamine to diethylene glycol monobutyl ether is from about 1:3 to about 1:5. In the Examples, the composition has a weight ratio of ethanolamine to diethylene glycol monobutyl ether of 1:3.5.

The cleaner compositions have a basic pH. The pH may be about 8.0 or higher, and suitably the pH is about 10.0 or higher, or even about 12.0 or higher. The pH of the cleaner composition in Example 1 is 13.5. The basic pH may be obtained by addition of a base to the cleaner composition. Suitable bases for inclusion in the cleaner compositions include, but are not limited to, sodium hydroxide, potassium hydroxide, and ammonium hydroxide. In the composition of Example 1, potassium hydroxide was used as the base.

As one of skill in the art will appreciate the amount of base added to the composition will be dependent on the strength of the base. The formulation in Example 1 contains 5% by weight potassium hydroxide. Suitably, the cleaner composition contains at least about 1% by weight base, more suitably the cleaner composition contains at least about 2%, 4%, 5%, or 7% by weight base. Suitably the cleaner composition contains less than about 12% by weight base, more suitably less than about 10%, 8%, or 6% by weight base. In the Examples, potassium hydroxide is present in the cleaning compositions in a weight ratio of 1:2 with diethylene glycol monoethyl ether and a 1:2.8 weight ratio with diethylene glycol monobutyl ether. The weight ratio of diethylene glycol monoalkyl ether to base may be from about 10:1 to about 1:1, suitably from about 8:1 to about 2:1, suitably from about 6:1 to about 4:1. Suitably, the weight ratio of diethylene glycol monoethyl ether to potassium hydroxide is from about 4:1 to about 1:1, more suitably from about 3:1 to about 2:1. Suitably, the weight ratio of diethylene glycol monobutyl ether to potassium hydroxide is from about 5:1 to about 1:1, more suitably from about 4:1 to about 2:1, more suitably from about 3:1 to about 2.5:1.

The cleaner compositions disclosed herein may also contain other additives such as surfactants, chelators, wetting agents, hydrotropes, fragrances, dyes, and thickening agents. Suitable surfactants will be apparent to those of skill in the art and include anionic, cationic, amphoteric, zwitterionic and nonionic surfactants and mixtures and combinations thereof. The amount of total surfactant included in the cleaner compositions may depend on various factors know to those of skill in the art, such as the type of surfactant chosen and the end use of the cleaner. The cleaner compositions may contain from about 0.1% by weight to about 20% by weight surfactant, suitably from about 0.5% by weight to about 15% by weight surfactant and more suitably from about 1% by weight to 10% by weight surfactant. Chelators are also known to those of skill in the art and include, for example, ethylene diamine tetracetic acid (EDTA). The cleaner compositions may contain from about 0.2% by weight to about 10% by weight chelator, suitably from about 1% by weight to about 6% by weight chelator and more suitably from about 2% by weight to 4% by weight chelator.

Those of skill in the art will appreciate that the weight percentages of the various constituents of the cleaner compositions could be varied depending on factors such as the level of soil, the type of soil (oily versus particulate), and the surface being cleaned. For example, the formulation in Example 1 could be made as a 2× concentrate by doubling the amount of each constituent and reducing the amount of water or could be diluted with water up to 10 fold for cleaning a more lightly soiled surface.

In yet another aspect, a cleaner composition is provided that includes diethylene glycol monoalkyl ether, benzyl alcohol, and an ethanolamine. In this aspect, the concentrations and ratios provided above for the various constituents would also apply.

The cleaner compositions can be made by any process known to those of skill in the art. Generally, the components are added to water with mixing. Then the pH may be adjusted to the desired level by adding a base. Finally, any colorants, fragrances and thickening agents may be added. The cleaner compositions may be used at full strength or may be diluted up to 10 fold. More concentrated cleaners would be suitable for cleaning highly soiled surfaces or difficult to clean surfaces and more dilute cleaners may be suitable for cleaning surfaces that are less soiled or easier to clean. The cleaner composition mixtures are stable and can be shipped or stored for an extended period of time.

Methods of cleaning a hard porous surface are also provided. First, the cleaner composition is applied to the surface. Then, the cleaner composition is agitated on the surface. Finally, the cleaner and loosened soil is removed from the surface. The cleaner compositions can be used in a variety of ways and on a variety of surfaces, which will be apparent to those of skill in the art. Generally, the cleaner will be applied such that it covers the surface and allowed to dwell for a period of time. The cleaner compositions may be left on the surface for five or more minutes, suitably for ten minutes or more. The product is agitated on the surface by scrubbing, wiping, or rubbing the surface by any means known to those of skill in the art. The cleaner composition and surface may be agitated at any point after application of the cleaner and prior to removal of the cleaner. For example, the cleaner composition and surface may be agitated at intervals throughout the dwell time, or only at the end of the dwell time. Finally, the surface may be rinsed to remove the cleaner and the loosened soil from the surface. If the surface is a floor, a floor cleaning machine, such as a rotary swing machine equipped with a bristle brush, may be used and the cleaner may be vacuumed off the floor prior to rinsing the floor with water.

The following examples are meant to be illustrative and as such are not meant to limit the scope of the claims.

EXAMPLES

Example 1

Cleaner Composition Formulation

A cleaning composition was made by mixing the following ingredients in the indicated percentages by weight:

| | |
|---|---|
| Water | 54% |
| Diethylene glycol monobutyl ether | 14% |
| Diethylene glycol monoethyl ether | 10% |
| Benzyl alcohol | 5% |
| Monoethanolamine | 4% |
| Zonyl ® FSO fluorosurfactant | 0.1% |
| Potassium hydroxide | 5% |
| Sodium xylene sulfonate | 4.5% |
| Tetrasodium salt of EDTA | 2.5% |
| Mirataine JC-HA | 0.5% |
| Alcohol alkoxylate Plurafac LF-221 | 0.2% |
| Alpine Superfresh #163-771M | 0.2% |

The cleaner composition had a pH of 13.5 and a surface tension of 30 dynes/cm. A 1:2 dilution had a surface tension of 28 dynes/cm and a 1:4 dilution had a surface tension of 25 dynes/cm as measured using a Kruss dynamic surface tensiometer. The cleaner composition has a total VOC of 4.35%. In the Examples below this formulation is called the cleaner composition of Example 1 or the prototype cleaning composition.

Example 2

Comparative Test of Grout and Tile Cleaning

Several products were tested to compare which product could clean and lighten soiled tile and grout the best.

Products Evaluated:

A. Akzo Nobel's perglutaric acid (PGA) mold and mildew remover. Ready to Use.
B. JWP Pro-Strip floor stripper. Neat concentration tested.
C. Prototype acid-solvent floor stripper. Neat concentration tested.
D. European Oxivir formulation. Neat concentration tested.
E. JWP Alpha HP (Wal Mart All in One cleaner). Neat concentration tested.
F. Warwick TAED wipe activated with Alpha HP at 1:16 generating approximately 1500 ppm PAA after 2 minutes.
G. JWP Pro-Strip and Azko Nobel's perglutaric acid
H. Vigorox peracetic acid at 1500 ppm.
I. Prototype low VOC cleaner. Neat concentration tested.

Testing Protocol:

The testing protocol was the same for each cleaner. All products were tested in a 3 tile by 3 tile square area. The tiles are 2⅞" by 2⅞" with a ⅛" grout line. The total area for each test was 81 square inches or 0.5625 square feet. 100 mls of working solution was poured over the 9 tiles and grout lines and allowed to dwell for 1 minute. After 1 minute, the tiles and grout lines were manually scrubbed with a medium bristle brush, like those found on a carpet spotting tamping brush. The tiles and grout lines were also scrubbed at 5 minutes and again at 10 minutes. At 10 minutes, the tiles were wiped clean with paper towel, rinsed with water, and wiped a second time. The percent soil removed was visually estimated on a scale from 0% removal to 100% removal, by several individuals in a blinded fashion. The tile and grout lines running up the wall slightly were used as a visual reference, as these tiles had a minimal soil load as compared to the flat tiles on the restroom floor.

Results:

A. Akzo Nobel's Perglutaric Acid Mold and Mildew Remover. Ready to Use.

The Akzo Nobel PGA product showed very good results. After 1 minute, some cleaning and lightening action had occurred. After 5 minutes, more cleaning had occurred. After 10 minutes of dwell time and 3 agitations, it was estimated that 50% of the soil was removed. See FIG. 1.

B. JWP Pro-Strip Floor Stripper. Neat Concentration Tested.

The Pro-Strip showed some of the best results of all products tested. After 1 minute, the soil tended to lift off quickly compared to most products tested. After 5 minutes, more cleaning had occurred. After 10 minutes of dwell time and 3 agitations, it was estimated that 80% or more of the soil was removed. See FIG. 2.

C. Prototype Acid-Solvent Floor Stripper. Neat Concentration Tested.

The acid solvent floor stripper showed minimal cleaning. After 10 minutes of dwell time and 3 agitations, it was estimated that 30% of the soil was removed. It was also noted that the product generated large amounts of foam when agitated which was undesirable. See FIG. 3.

D. European Oxivir Formulation (6.9% H2O2). Neat Concentration Tested.

The EMA Oxivir formulation showed minimal cleaning effects. After 10 minutes of dwell time and 3 agitations, it was estimated that 35% of the soil was removed. It was also noted that the product generated large amounts of foam when agitated. See FIG. 4.

E. JWP Alpha HP Formulation (4.25% H2O2). Neat Concentration Tested.

The Alpha HP formulation showed minimal cleaning effects. After 10 minutes of dwell time and 3 agitations, it was estimated that 20% of the soil was removed. It was also noted that the product generate large amounts of foam when agitated. See FIG. 5.

F. Warwick TAED Wipe Activated with Alpha HP at 1:16 Generating Approximately 1500 ppm PAA after 2 Minutes.

After 10 minutes, no reaction was observed under the PAA wipe treated with Alpha HP. No photo was captured because of poor results.

G. JWP Pro-Strip and Akzo Nobel PGA

Two-part testing was conducted with JWP Pro-Strip being applied first for 10 minutes with agitation at 1, 5 and 10 minutes, followed by a 10 minute dwell time with the Akzo PGA product with no agitation in hopes that further cleaning would be observed with the use of these two products. However, there were no apparent synergies observed when treating the tile and grout with Pro-Strip followed by the Akzo PGA product (i.e. no improvements on overall soil removal were observed).

H. Vigor Ox Peracetic Acid at 1500 ppm.

After 1 minute, slight cleaning or lightening of the grout lines was occurring. No additional cleaning or lightening was observed at 5 minutes or 10 minutes. It was estimated that approximately 10% soil removal had occurred. See FIG. 6.

I. Prototype Low VOC Alkaline Solvent Cleaner of Example 1

The low VOC floor cleaner showed the best results of all products tested. After 1 minute, the soil tended to lift off very quickly compared to most products tested. After 5 minutes, more cleaning had occurred. After 10 minutes of dwell time and 3 agitations, it was estimated that 85-90% or more of the soil was removed. See FIG. 7.

Conclusion:

As shown in FIG. 8, the best performing product was the prototype high solvent, low VOC formulation of Example 1 when used undiluted. This yielded approximately 85-90% soil removal. The second best product was the Pro-Strip formula that was also used undiluted and achieved approximately 80% soil removal. This is not really an option since the VOC level on Pro-Strip is rather high. The third best technology was the Akzo Nobel PGA product, which yielded approximately 70% soil removal. It was visually apparent that the prototype low VOC solvent cleaner and Pro-Strip performed better than the Akzo PGA product. Other products, like EMA Oxivir, Alpha HP, and peracetic acid had some effect on cleaning and lightening of the tile and grout, but not to the extent of the three other products mentioned above.

Example 3

Field Test of Floor Cleaning

The top two products from the comparative tests in Example 2, namely the prototype low VOC floor cleaner and Pro-Strip were tested in restroom floor cleaning field tests. As noted above, the prototype cleaner has a total VOC of 4.35%, while Pro-Strip has a total VOC of 27% when used undiluted. The floor was mopped with a heavy solution of cleaner, allowed to dwell for 5 minutes, and then agitated with a Taski swing machine. The solution was then vacuumed up and wet mopped with clean water. The prototype low VOC floor cleaner performed best in the test and resulted in significant removal of soil from both the tile and the grout lines. When evaluated in a blinded fashion, the Pro-Strip cleaner removed about 75-80% of the soil and the prototype low VOC cleaner removed about 90-95% of the soil.

Throughout this disclosure, various aspects of this invention may be presented in a range format. It should be understood that the description in range format is merely for convenience and brevity, and should not be construed as an inflexible limitation on the scope of the invention. Accordingly, as will be understood by one skilled in the art, for any and all purposes, particularly in terms of providing a written description, all ranges disclosed herein also encompass any and all possible subranges and combinations of subranges thereof, as well as integral and fractional numerical values within that range.

The above detailed description of the invention is illustrative of certain embodiments of the invention and is not intended to limit the scope of the invention as set forth in the appended claims.

We claim:

1. A cleaner composition comprising: from about 5% by weight to about 30% by weight diethylene glycol monobutyl ether; from about 5% by weight to about 25% by weight diethylene glycol monoethyl ether; benzyl alcohol; and a fluorosurfactant.

2. The composition of claim 1, further comprising an ethanolamine.

3. The composition of claim 2, wherein the ethanolamine is selected from the group consisting of monoethanolamine, diethanolamine and triethanolamine.

4. The composition of claim 2, wherein the diethylene glycol monobutyl ether and the ethanolamine are present in a weight ratio of from about 6:1 to about 2:1.

5. The composition of claim 1, further comprising a base.

6. The composition of claim 5, wherein the base is selected from the group consisting of sodium hydroxide, potassium hydroxide, ammonium hydroxide.

7. The composition of claim 1, wherein the pH of the composition is 8.0 or higher.

8. The composition of claim 1, wherein the pH of the composition is about 12.0 or higher.

9. The composition of claim 1 wherein the fluorosurfactant is a non-ionic fluorosurfactant.

10. The composition of claim 1, further comprising a chelator.

11. The composition of claim 1, further comprising a hydrotrope.

12. The composition of claim 1, wherein the diethylene glycol monobutyl ether and the diethylene glycol monoethyl ether are present in a weight ratio of from about 4:1 to about 1:1.

13. The composition of claim 1, wherein the diethylene glycol monobutyl ether and the benzyl alcohol are present in a weight ratio of from about 5:1 to about 2:1.

14. The composition of claim 1, wherein the composition comprises from about 50 ppm to about 2500 ppm of a fluorosurfactant.

15. The composition of claim 1, wherein the composition comprises from about 5% by weight to about 30% by weight diethylene glycol monobutyl ether; from about 5% by weight to 20% by weight diethylene glycol monoethyl ether; from about 1% by weight to about 10% by weight benzyl alcohol; and from about 0.05% by weight to about 1% by weight fluorosurfactant.

16. The composition of claim 15, further comprising from about 1% by weight to about 10% by weight ethanolamine.

17. The composition of claim 1, wherein the composition comprises about 14% by weight diethylene glycol monobutyl ether; about 10% by weight diethylene glycol monoethyl ether; about 5% by weight benzyl alcohol; and about 0.1% by weight fluorosurfactant.

18. The composition of claim 17, further comprising about 4% by weight monoethanolamine.

19. The composition of claim 1, wherein the diethylene glycol monoethyl ether and the benzyl alcohol are present in a weight ratio of from about 4:1 to about 1:1.

20. The composition of claim 2, wherein the diethylene glycol monoethyl ether and the ethanolamine are present in a weight ratio of from about 4:1 to about 2:1.

21. The composition of claim 1, wherein the diethylene glycol monobutyl ether and diethylene glycol monoethyl ether together comprise at least about 20% by weight of the composition.

* * * * *